US005437159A

United States Patent [19]

Ansart et al.

[11] Patent Number: 5,437,159

[45] Date of Patent: Aug. 1, 1995

[54] FUEL INJECTION SYSTEM FOR A GAS TURBINE COMBUSTOR INCLUDING RADIAL FUEL SPRAY ARMS AND V-GUTTER FLAMEHOLDERS

[75] Inventors: Denis R. H. Ansart, Bois le Roi; Jacques L. M. Maunand, St. Forget, both of France

[73] Assignee: Societe Nationale d'Etude et de Construction de Moteurs d'Aviation (S.N.E.C.M.A.), Valin, France

[21] Appl. No.: 260,727

[22] Filed: Jun. 15, 1994

[30] Foreign Application Priority Data

Jun. 16, 1993 [FR] France ..... 93 07235

[51] Int. Cl.[6] ..... F23R 3/28

[52] U.S. Cl. ..... 60/746; 60/749

[58] Field of Search ..... 60/737, 739, 742, 746, 60/740, 749, 261; 239/403, 461

[56] References Cited

U.S. PATENT DOCUMENTS

| | | | |
|---|---|---|---|
| 2,715,813 | 8/1955 | Holmes et al. | 60/746 |
| 2,780,916 | 2/1957 | Collins . | |
| 3,026,675 | 2/1962 | Vesper et al. . | |
| 3,747,345 | 7/1973 | Markowski . | |
| 3,800,530 | 4/1974 | Nash . | |
| 4,052,844 | 10/1977 | Caruel et al. . | |
| 4,474,014 | 10/1984 | Markowski | 60/746 |
| 5,054,280 | 10/1991 | Ishibashi et al. | 60/749 |
| 5,142,858 | 9/1992 | Ciokajlo et al. | 60/746 |
| 5,199,265 | 4/1993 | Borkowicz | 60/746 |
| 5,203,796 | 4/1993 | Washam et al. | 60/742 |

FOREIGN PATENT DOCUMENTS

| | | |
|---|---|---|
| 488556 | 6/1992 | European Pat. Off. . |
| 1166520 | 11/1958 | France . |
| 2172339 | 9/1973 | France . |

*Primary Examiner*—Timothy S. Thorpe
*Attorney, Agent, or Firm*—Bacon & Thomas

[57] ABSTRACT

A fuel injection system for a gas turbine engine combustion chamber is disclosed having a sleeve defining a passageway extending along a longitudinal axis of a combustion zone, a first fuel injector orifice to inject fuel into the passageway, and second fuel injector holes arranged in a plurality of substantially linear arrays extending radially from the sleeve and angularly equidistantly spaced from each other, the second fuel injection holes located in a plane extending substantially perpendicular to the longitudinal axis of the combustion chamber such that the plane is located axially between an upstream end wall of the combustion chamber and the downstream end of the sleeve. The system also includes a flameholder having a plurality of flameholder arms extend axially from second fuel injection arms such that the downstream ends of the flameholder arms extend to at least the downstream end of the sleeve and extend generally radially from the sleeve such that the flameholder arms are circumferentially located between the angularly spaced apart linear arrays of fuel injection holes.

12 Claims, 3 Drawing Sheets

FUEL INJECTION SYSTEM FOR A GAS TURBINE COMBUSTOR INCLUDING RADIAL FUEL SPRAY ARMS AND V-GUTTER FLAMEHOLDERS

BACKGROUND OF THE INVENTION

The present invention relates to a fuel injection system for a gas turbine engine, more particularly such a system which creates a fuel and air premixing zone between the fuel injection sites and a downstream edge of a flameholder.

Fuel injection systems for gas turbine engine combustion chambers are known and typical examples are illustrated in U.S. Pat. No. 5,193,346 and European Patent 0 488 556. These systems comprise first and second fuel injection assemblies which are substantially centered relative to a central axis of the combustion chamber. They also include a flameholder inside the combustion chamber displaced away from the upstream end wall of the chamber. In these known systems, a first fuel injection assembly is located on the central axis and is enclosed by a sleeve extending axially along the axis so as to be coaxial therewith and a second fuel injection assembly which is located axially downstream of the sleeve along the axis. The second fuel injection assembly is axially offset from the transverse downstream end of the sleeve which is furtherest from the upstream end wall of the combustion chamber. The second fuel injection assembly is located between the transverse end of the sleeve and the upstream end wall of the combustion chamber.

The known fuel injection systems do not permit the stabilization of the combustion in the immediate vicinity of the upstream end of the combustion chamber and, as a result, do not satisfactorily reduce the emission of nitrogen oxides ($NO_x$) nor do they allow the homogenizing of the local fuel/air mixture richness.

SUMMARY OF THE INVENTION

A fuel injection system for a gas turbine engine combustion chamber is disclosed having a sleeve defining a passageway extending along a longitudinal axis of a combustion zone, a first fuel injector orifice to inject fuel into the passageway, and second fuel injector holes arranged in a plurality of substantially linear arrays extending radially from the sleeve and angularly equidistantly spaced from each other, the second fuel injection holes located in a plane extending substantially perpendicular to the longitudinal axis of the combustion chamber such that the plane is located axially between an upstream end wall of the combustion chamber and the downstream end of the sleeve. The system also includes a flameholder having a plurality of flameholder arms extending axially from second fuel injection arms such that the downstream ends of the flameholder arms extend to at least the downstream end of the sleeve and extend generally radially from the sleeve such that the flameholder arms are circumferentially located between the angularly spaced apart linear arrays of fuel injection holes.

In a first embodiment of the invention, the outermost ends of the flameholder arms lie on a radius greater than the radius on which lie the outermost ends of the linear array of second fuel injection holes. Alternatively, the ends of both the flameholder arms and the linear array of fuel injection holes may lie on ellipses such that the ellipse containing the outermost ends of the flameholder arms is larger than that containing the ends of the linear arrays of fuel injection holes.

The fuel injection system according to the present invention creates a premixing zone between the fuel injection sites and the plane of the flameholders. The second fuel injection assembly comprises a plurality of fuel injection holes arranged in a linear array extending in a plane generally perpendicular to the longitudinal axis of the combustion zone and which are equidistantly angularly spaced from each other. The flameholder device comprises flameholder arms which extend axially from the plane of the second fuel injection assembly at least to the downstream end of the sleeve and which also extend radially from the outside of the sleeve such that they are located circumferentially between the angularly spaced apart radial arrays of fuel injection holes.

According to the invention, each of the flameholder arms preferably extends axially beyond the downstream end of the sleeve and the cross-section of each of the flameholder arms comprises a substantially "V"-shape with the vertex of the "V" pointing upstream towards the end wall of the combustion chamber.

The linear array of fuel injection holes may be defined by a plurality of fuel injection arms which extend radially from the outer surface of the sleeve. Each of the fuel injection arms may comprise a circular cross-section wherein the fuel injection holes point in a downstream direction into the combustion chamber, or they may assume a tapered configuration wherein the downstream sides of the arms taper toward each other and wherein the fuel injection holes extend laterally on either side of each of the arms. The injection arms may also comprise first and second portions wherein a downstream, second portion defines a concavity into which the fuel injection holes issue and wherein each of the first and second portions define internal cooling conduits. The cooling conduits are connected to each other such that a coolant, such as fuel, passes through the conduits defined by the downstream portion, through the conduits defined by the upstream portion and is subsequently injected through the fuel injection holes.

The main advantage offered by the fuel injection system according to the present invention is the decrease in produced nitrogen oxides ($NO_x$) and in stabilizing the combustion at the upstream end of the combustion chamber.

DETAILED DESCRIPTION OF THE PREFERRED EMBODIMENTS

Figure 1:
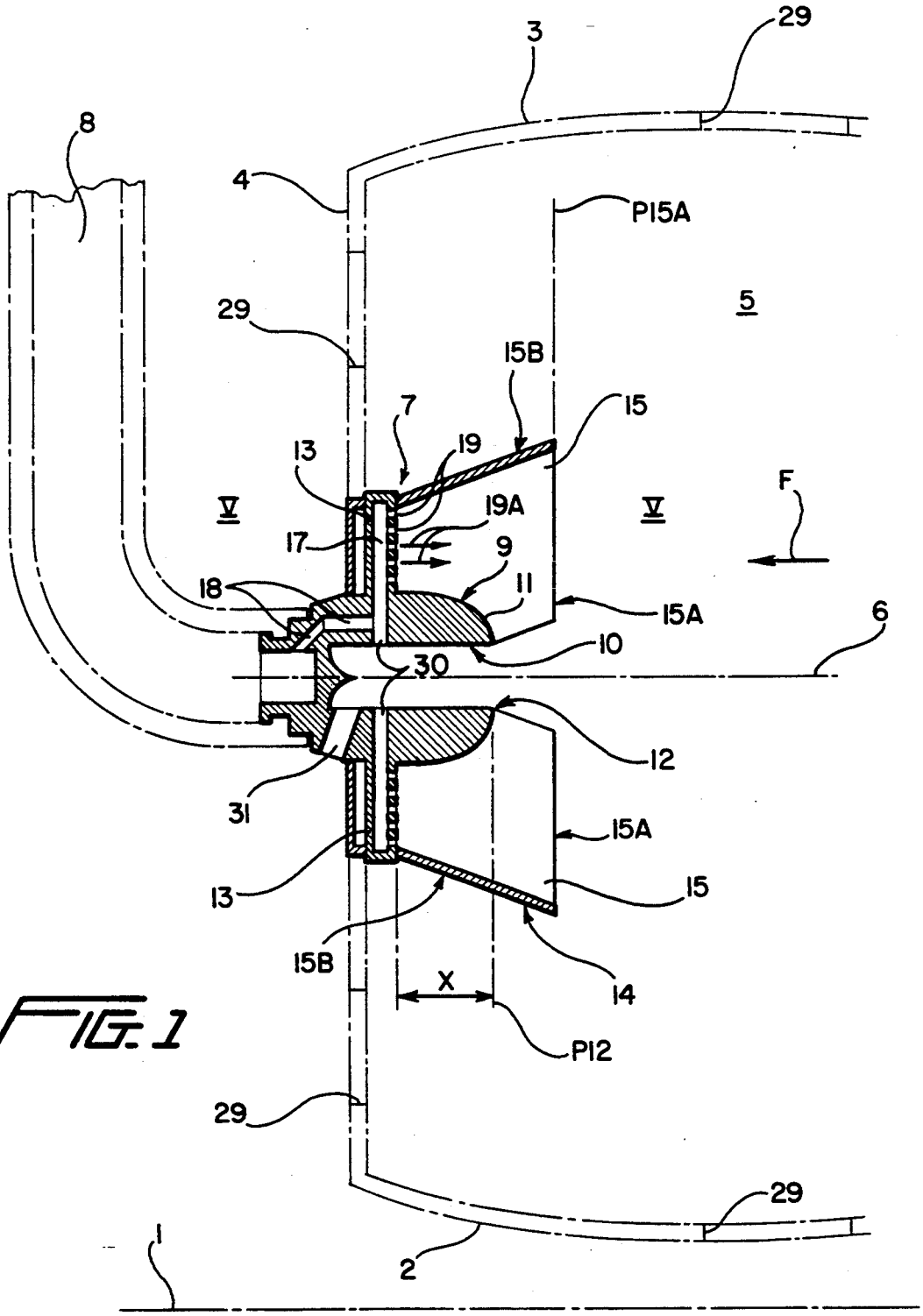
FIG. 1 is a partial, longitudinal cross-sectional view of a combustion chamber of a gas turbine engine including the fuel injection system according to the present invention.

FIG. 1 is a partial, cross-sectional view illustrating a combustion chamber of a gas turbine engine including the fuel injection system according to the present invention. As can be seen, the gas turbine engine has a central axis of symmetry 1 about which extends inner annular wall 2 and outer annular wall 3. A transverse, upstream end wall 4 extends substantially perpendicular to the axis 1 and connects the upstream ends of inner annular wall 2 and outer annular wall 3 so as to define a combustion chamber 5. Combustion chamber 5 has a longitudinal axis 6 of the combustion zone.

A fuel injection system 7 is connected to a main fuel supply conduit 8 so as to supply fuel to the interior of the combustion chamber 5. The fuel injection system 7 comprises a sleeve 9 which extends through and is affixed to the upstream end wall 4 and which defines a central passageway 10. The sleeve 9 has a generally axially extending outer surface 11 which extends from the end wall 4 in a downstream direction into the combustion chamber to the transverse plane P12 extending generally transversely of the longitudinal axis 6. As can be seen, plane P12 extends generally perpendicular to the longitudinal axis 6 and is located a distance "x" from fuel injection arms 13. Fuel injection arms 13 extend generally radially from the sleeve 9 with respect to the axis 6 and He in a plane extending substantially perpendicular to the axis 6. The injection arms 13, extending in a radial fashion from axis 6 and the sleeve 9, extend from the outer surface 11 of the sleeve 9 and are rigidly attached thereto.

The fuel injection system also includes a plurality of flameholder arms 14, each flameholder arm comprising two legs 15 forming a generally "V"-shaped cross-sectional configuration in which the vertex of the "V"-shape faces in an upstream direction, toward the end wall 4. Each flameholder arm 14 is circumferentially located between adjacent injection arms 13 and each also extends radially from the sleeve 9 with respect to the longitudinal axis 6. The flameholder arms 14 are oriented such that they bisect the angle between adjacent fuel injection arms 13. A plane P14 which bisects the angle formed by the legs 15 of each flameholder arm 14 passes through the axis 6.

Figure 2:
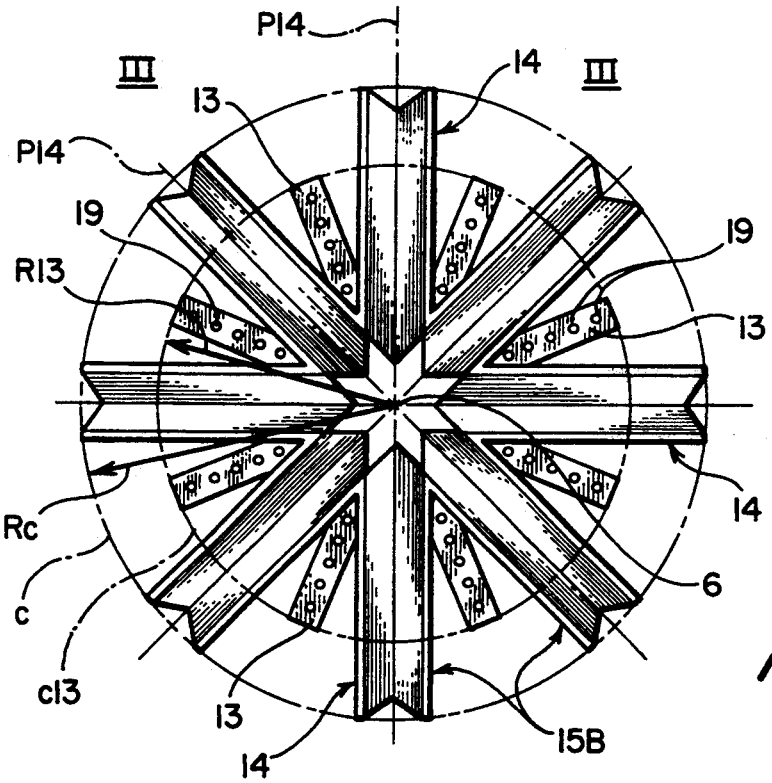
FIG. 2 is a partial view, taken in the direction of arrow F in FIG. 1 illustrating a first embodiment of the fuel injection system according to the present invention.
Figure 3:
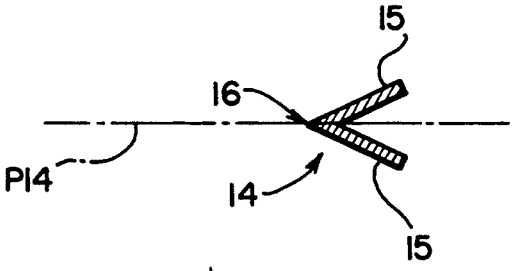
FIG. 3 is a cross-sectional view taken along line III—III in FIG. 2.

The vertex 16 of each flameholder arm 14 is located adjacent to the plane of the chamber end wall 4 and the legs 15 extend downstream axially away from the end wall 4 beyond the plane P12 to plane P15A which also extends perpendicular to the axis 6 and contains the downstream edges 15A of each of the legs 15. Each flameholder arm 14 has an axial edge 15B which also extends downstream from the upstream end wall 4 and which diverges away from the longitudinal axis 6 in a downstream direction. As can be seen in FIG. 2, the outermost portions of the downstream edges 15A are located on a circle C centered on the axis 6 having a radius $R_c$ which is larger than the radius R13 of a circle C 13 on which are located the radially outermost ends of the fuel injection arms 13.

Figure 4:
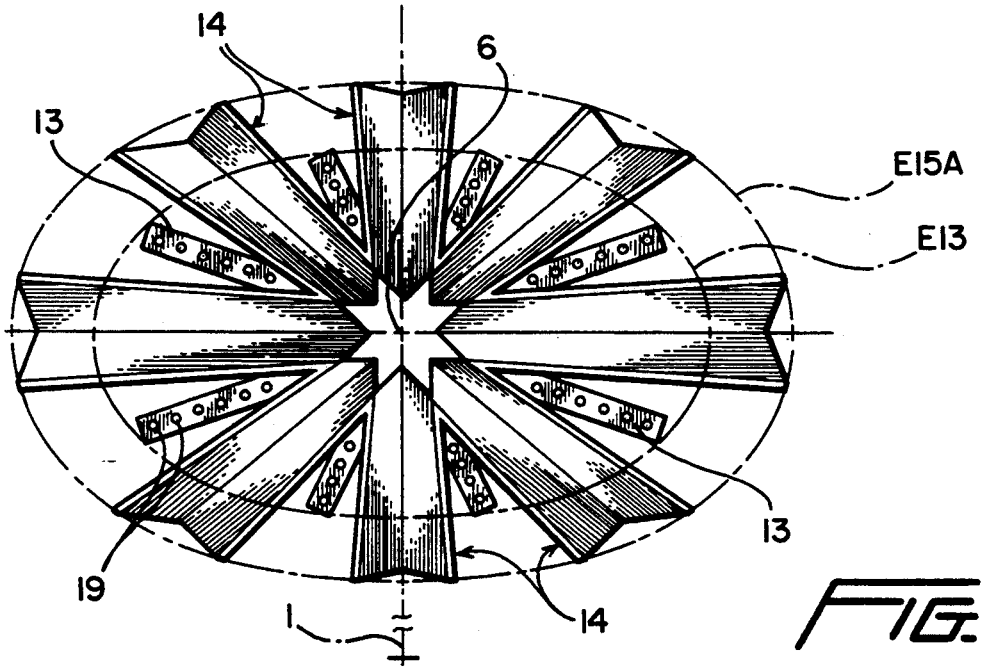
FIG. 4 is a partial view, similar to FIG. 2, but illustrating an alterative configuration of the fuel injection system according to the present invention.

Alternatively, in order to restrict the bulk of the fuel injection system in the radial direction from axis 1 the aforementioned dimensions of the flameholder arms 14 parallel to the direction from axis 1 to axis 6 may be preserved, but the dimensions in a direction substantially perpendicular to the directions between axis 1 and axis 6 may be increased. As a result, as illustrated in FIG. 4, the ends of the injection arms 13 are arrayed along an ellipse E13 and the radially outermost ends of edges 15A of the flameholder 14 are arrayed along an ellipse E15A which is larger than and encloses the ellipse E13. Obviously, the curves E13 and E15A may slightly deviate from a true elliptical configuration without exceeding the scope of this invention.

Figure 5:
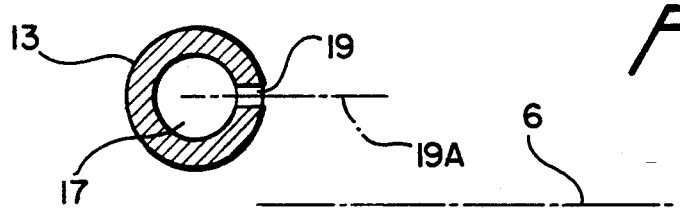
FIG. 5 is a cross-sectional view taken along line V—V in FIG. 1 of a first embodiment of a fuel injection arm according to the present invention.

Each of the fuel injection arms 13 may define a generally radially extending fuel feed conduit 17 which communicates via conduits 18 in the sleeve 9 with the main fuel supply conduit 8. A plurality of injection holes 19 with axis **19*a* extending parallel to the axis 6 are defined by each of the fuel injection arms so as communicate with the conduit 17 to enable fuel to pass into the combustion chamber 5. This configuration is illustrated in FIGS. 1 and 5**.

Figure 6:
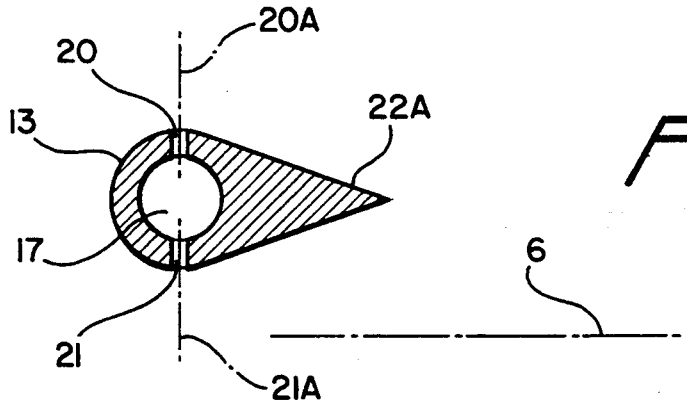
FIG. 6 is a cross-section view, similar to FIG. 5, illustrating a second embodiment of the fuel injection arm according to the present invention.

Alternatively, as illustrated in FIG. 6, each of the fuel injection arms 13 may define a pair of linear arrays of injection holes 20 and 21 each having axes 20A and 21A located in a plane which extends substantially perpendicular to the axis 6 and orthogonal to the radial direction of the injection arm 13. The injection holes 20 and 21 communicate with the conduit 17 and enable fuel to pass into the combustion chamber 5. In this embodiment, the cross-section of each arm 13 tapers into a tip 22A which extends in a downstream direction away from the upstream end wall 4.

Figure 7:
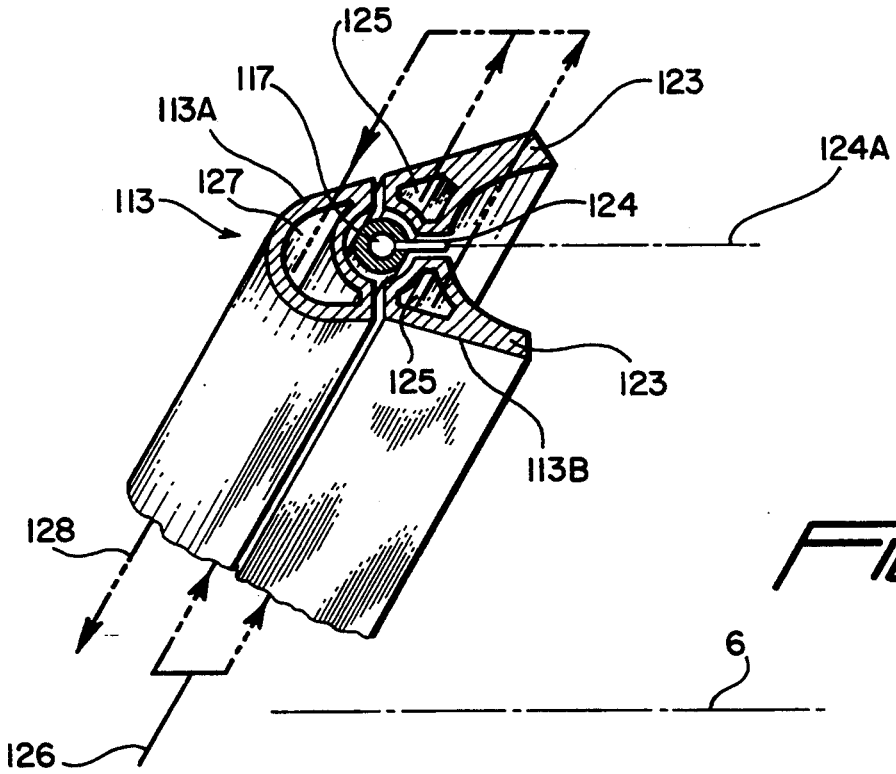
FIG. 7 is a partial, perspective, cross-sectional view illustrating a third embodiment of the fuel injection arm according to the present invention.

In another embodiment, illustrated in FIG. 7, each of the injection arms 113 comprises a first portion 113A and a second portion 113B wherein the fuel feed conduit 117 is defined between these two portions. The second portion 113B defines a concavity extending along the length of the fuel injection arm 113 which is bounded by opposite sides 123. A plurality of fuel injection holes 124 issue into the center of the concavity and communicate with the fuel conduit 117. The portion 113B defines two cooling conduits 125 which communicate with a coolant supply conduit 126 at one end and with a cooling conduit 127 defined by portion 113A at opposite ends. Cooling conduit 127 also communicates with a return coolant conduit 128 which is also part of the cooling circuit. The opposite sides 123 point away from the upstream combustion chamber end wall 4 in a downstream direction. The axes 124A of injection holes 124 extend substantially parallel to the longitudinal axis 6. As the coolant flows through conduits 125, it cools the hottest pan 113B which is most exposed to the flames in the combustion chamber 5 and, on its return path, the coolant passes through the conduit 127 to cool the second portion of the fuel injection arm 113. The coolant may be fuel which is pre-heated as it passes through portions 113B and 113A prior to its being injected into its combustion chamber 5. Arms 113 are arrayed similarly to the array of arms 13 as disclosed in the previous embodiments.

First fuel injection holes 30 are defined by the sleeve 9 and issue into the passageway 10 to enable fuel to enter the passageway. An oxidizer intake 31 is also defined by the sleeve 9 and is preferably of a swirler type associated with the first fuel injection holes 30. The fuel injection holes 30 are located axially in the plane of the conduits 17 defined by the injection arms 13 and are supplied fuel via the conduit 18.

Oxidizer intake orifices 29 are defined in the inner and outer walls 2 and 3, respectively, as well as the combustion chamber end wall 4 near the injection arms 13 to make it possible to feed an oxidizer, in particular a primary oxidizer to burn the fuel, into the combustion chamber. Generally, this oxidizer is air tapped from an upstream air compressor (not shown).

The distance "x" is selected in such a manner so as to preclude fuel self-ignition under all operating modes with a margin of safety being provided. The oxidizer supply, in particular entering through the upstream combustion chamber end wall 4 allows achieving considerable permeability and thereby lowers the average equivalence ratio to approximately 0.6.

The distribution of fuel injected through the fuel injected holes 19 and 30 is computed and controlled so as to achieve the best trade-offs between satisfactory combustion stability, minimal pollution and safe wall temperatures, particularly in regard to the inner and outer annular walls 2 and 3 respectively.

The embodiment illustrated in FIG. 4 allows limiting the number of injection arms adjacent to the combustion chamber end, while at the same time increasing the number of fuel injection holes thereby achieving less disturbances of the fluid flow in the fuel injection system.

The main advantages of the fuel injection system according to the present invention are the lowering of the quantity of emitted nitrogen oxides and the stabilization of the combustion near the upstream end of the combustion chamber.

The foregoing description is provided for illustrative purposes only and should not be construed as in any way limiting this invention, the scope of which is defined solely by the appended claims.

We claim:

1. A fuel injection system for a combustion chamber for a gas turbine engine, the combustion chamber having an end wall extending transversely with respect to a central axis of the combustion chamber and defining a combustion zone having a longitudinal axis extending substantially parallel to the central axis, the system comprising:

a) a sleeve defining a passageway extending along the longitudinal axis of the combustion chamber, the sleeve having an outer surface and a downstream end extending into the combustion chamber;

b) first fuel injection means to inject fuel into the passageway;

c) second fuel injection means to inject fuel into the combustion chamber, the second fuel injection means comprising means defining a plurality of fuel injection arms, each having at least one substantially linear array of fuel injection holes, the arms extending radially away from the outer surface of the sleeve so as to be substantially angularly equidistant from each other, and located in a plane extending substantially perpendicular to the longitudinal axis of the combustion zone, the plane located axially between the end wall and the downstream end of the sleeve; and, d) a flameholder apparatus comprising a plurality of flameholder arms, each flameholder arm extending axially from the second fuel injection means to at least the downstream end of the sleeve, the flameholder arms extending radially away from the outer surface of the sleeve and circumferentially located between the angularly spaced apart fuel injection arms, wherein each flameholder arm comprises a generally "V"-shaped cross-sectional configuration with the apex of the "V"-shape facing toward and located adjacent to a plane of the end wall of the combustion chamber.

2. The fuel injection system of claim 1 wherein each flameholder arm extends axially beyond the downstream end of the sleeve.

3. The fuel injection system of claim 1 wherein the outermost ends of the flameholder arms lie on a radius $R_c$ about the longitudinal axis of the combustion zone and the outermost ends of the linear arrays of fuel injection holes lie on a radius $R_{13}$ whereby $R_c > R_{13}$.

4. The fuel injection system of claim 1 wherein the outermost ends of the flameholder arms lie on an ellipse.

5. The fuel injection system of claim 1 wherein each fuel injection arm comprises first and second portions, the first portion defining at least one first cooling conduit and the second portion defining at least one second cooling conduit.

6. The fuel injection system of claim 5 further comprising:

a) first conduit means interconnecting the at least one first and second cooling conduits;

b) second conduit means connecting one of the at least one first and second cooling conduits to a coolant source; and, c) third conduit means connecting the other of the at least one first and second cooling conduits to a coolant return.

7. The fuel injection system of claim 5 wherein the coolant is fuel to be subsequently injected into the combustion chamber.

8. The fuel injection system of claim 1 wherein each fuel injection hole has an axis extending substantially parallel to the longitudinal axis of the combustion zone.

9. The fuel injection system of claim 1 wherein each fuel injection hole has an axis extending substantially perpendicular to the longitudinal axis of the combustion zone.

10. The fuel injection system of claim 1 wherein each fuel injection arm defines two linear arrays of fuel injection holes.

11. The fuel injection system of claim 10 wherein axes of the fuel injection holes lie in a plane extending substantially perpendicular to the longitudinal axis of the combustion zone.

12. The fuel injection system of claim 1 wherein each fuel injection arm has a substantially circular cross-sectional configuration.

* * * * *